US011066143B2

(12) United States Patent
Doremus et al.

(10) Patent No.: US 11,066,143 B2
(45) Date of Patent: Jul. 20, 2021

(54) COOLING SYSTEM FOR ELECTRIC PROPULSION SYSTEM OF WATERCRAFT

(71) Applicant: GM GLOBAL TECHNOLOGY OPERATIONS LLC, Detroit, MI (US)

(72) Inventors: Jonathan D. Doremus, Novi, MI (US); Trevor Fayer, Milford, MI (US); Eric T. Wills, South Lyon, MI (US)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 241 days.

(21) Appl. No.: 16/274,792

(22) Filed: Feb. 13, 2019

(65) Prior Publication Data

US 2020/0255112 A1 Aug. 13, 2020

(51) Int. Cl.

| | |
|---|---|
| ***B63B 3/38*** | (2006.01) |
| ***B63H 21/38*** | (2006.01) |
| ***B63H 21/17*** | (2006.01) |

(52) U.S. Cl.

CPC ..... *B63H 21/383* (2013.01); *B63B 3/38* (2013.01); *B63H 21/17* (2013.01); *B63B 2003/387* (2013.01)

(58) Field of Classification Search

CPC ..... B63H 21/383; B63H 21/17; B63B 3/38
See application file for complete search history.

(56) References Cited

U.S. PATENT DOCUMENTS

| | | | | |
|---|---|---|---|---|
| 3,841,396 | A * | 10/1974 | Knaebel | B63H 21/10 165/44 |
| 6,015,320 | A * | 1/2000 | Nanami | B63H 21/386 440/88 L |
| 6,544,085 | B1 * | 4/2003 | Menard | B63H 21/383 440/88 C |
| 7,128,025 | B1 * | 10/2006 | Westhoff, Jr. | F01P 3/202 123/41.01 |
| 8,682,516 | B1 * | 3/2014 | Balogh | B63H 23/30 701/21 |
| 9,545,985 | B1 * | 1/2017 | Provost | B63H 20/002 |
| 2003/0166363 | A1 * | 9/2003 | Matsuda | F02B 61/045 440/88 C |
| 2011/0159753 | A1 * | 6/2011 | Ozaki | B63H 21/38 440/88 L |
| 2020/0255112 | A1 * | 8/2020 | Doremus | B63H 21/17 |

* cited by examiner

*Primary Examiner* — S. Joseph Morano
*Assistant Examiner* — Jovon E Hayes
(74) *Attorney, Agent, or Firm* — Cantor Colburn LLP

(57) ABSTRACT

A cooling system for a boat includes at least one cooler located inside a hull of the boat and closed to the exterior of the hull. The cooler is configured for the exchange of thermal energy between a flow of coolant in the at least one cooler and a fluid flow outside of the hull via a hull wall positioned between the flow of coolant and the fluid flow. One or more coolant passages extend from the at least one cooler defining at least one coolant loop. The one or more coolant passages are configured to deliver the flow of coolant from the at least one cooler to one or more components located along the at least one coolant loop to cool the one or more components, and return the flow of coolant to the at least one cooler.

16 Claims, 6 Drawing Sheets

COOLING SYSTEM FOR ELECTRIC PROPULSION SYSTEM OF WATERCRAFT

INTRODUCTION

The subject disclosure relates to watercraft, and more particularly to cooling systems for boat propulsion systems and components.

Traditional marine cooling systems utilize water drawn through the hull of the boat as a cooling fluid. The water is drawn into the boat from the body of water (also referred to herein as seawater) in which the boat is operating via a pump, then in some systems routed through a heat exchanger for thermal energy exchange with a flow of coolant also circulated through the heat exchanger. The coolant is then circulated to an engine, motor, or other component to cool said component before being recirculated to the heat exchanger. The water, after flowing through the heat exchanger, is dumped overboard by the marine cooling system.

In such a system, the flow through the cooling system continues as long is the engine is running. Such a system requires the intake of seawater through the hull. Further, such systems are problematic in some boats, such as those propelled via battery-powered electric motors, which do not have an operational idle mode or speed. In such a boat, the cooling of components such as the electric motor and the batteries would stop unless the boat is under power. In other systems, keel coolers, mounted to an exterior of the hull, are utilized. The keel coolers introduce additional drag to the hull and require multiple holes be drilled though the hull, which introduces additional potential failure points to the system. Further, keel coolers, due to their location outside of the hull are susceptible to damage due to collision with submerged objects.

SUMMARY

In one embodiment, a cooling system for a boat includes at least one cooler located inside a hull of the boat and closed to the exterior of the hull. The cooler is configured for the exchange of thermal energy between a flow of coolant in the at least one cooler and a fluid flow outside of the hull via a hull wall positioned between the flow of coolant and the fluid flow. One or more coolant passages extend from the at least one cooler defining at least one coolant loop. The one or more coolant passages are configured to deliver the flow of coolant from the at least one cooler to one or more components located along the at least one coolant loop to cool the one or more components, and return the flow of coolant to the at least one cooler.

Additionally or alternatively, in this or other embodiments the at least one cooler is located at a chine of the hull.

Additionally or alternatively, in this or other embodiments a chine closure is secured to an interior of the hull to enclose a chine recess defined by the chine. The enclosed chine recess defines a cooler of the at least one cooler.

Additionally or alternatively, in this or other embodiments the chine closure is secured to the interior of the hull via welding.

Additionally or alternatively, in this or other embodiments the hull is formed from aluminum.

Additionally or alternatively, in this or other embodiments the one or more components are one or more electrical components of a boat propulsion system.

Additionally or alternatively, in this or other embodiments a pump is configured to urge the flow of coolant along the at least one coolant loop.

Additionally or alternatively, in this or other embodiments the at least one cooler is two coolers located at opposing lateral sides of the hull.

Additionally or alternatively, in this or other embodiments the at least one cooling loop is two coolant loops. A first coolant loop of the two coolant loops includes a first cooler of the two coolers, and a second coolant loop of the two coolant loops includes a second cooler of the two coolers.

Additionally or alternatively, in this or other embodiments the first coolant loop and the second coolant loop are configured and arranged to cool different components of the one or more components.

Additionally or alternatively, in this or other embodiments the fluid flow is one of water or air.

In another embodiment, a boat includes a hull and a propulsion system located in the hull and configured to propel the hull. A cooling system is located in the hull and is configured to cool one or more components of the propulsion system. The cooling system includes at least one cooler positioned inside the hull and closed to the exterior of the hull. The cooler is configured for the exchange of thermal energy between a flow of coolant in the at least one cooler and a fluid flow outside of the hull via a hull wall positioned between the flow of coolant and the fluid flow. One or more coolant passages extend from the at least one cooler defining at least one coolant loop. The one or more coolant passages are configured to deliver the flow of coolant from the at least one cooler to the one or more components located along the at least one coolant loop to cool the one or more components, and return the flow of coolant to the at least one cooler.

Additionally or alternatively, in this or other embodiments the at least one cooler is located at a chine of the hull.

Additionally or alternatively, in this or other embodiments a chine closure is secured to an interior of the hull to enclose a chine recess defined by the chine. The enclosed chine recess defines a cooler of the at least one cooler.

Additionally or alternatively, in this or other embodiments the at least one cooler is two coolers located at opposing lateral sides of the hull.

Additionally or alternatively, in this or other embodiments the at least one cooling loop is two coolant loops. A first coolant loop of the two coolant loops includes a first cooler of the two coolers, and a second coolant loop of the two coolant loops includes a second cooler of the two coolers.

Additionally or alternatively, in this or other embodiments the first coolant loop and the second coolant loop are configured and arranged to cool different components of the one or more components.

Additionally or alternatively, in this or other embodiments the propulsion system is an electrical propulsion system including an electric motor, a prop operably connected to the electric motor and driven thereby, and one or more batteries operably connected to the electric motor to provide electrical power to the electric motor. The one or more components include at least one of the electric motor or the one or more batteries.

Additionally or alternatively, in this or other embodiments the boat includes a center hull and two outer hulls disposed laterally outboard of the center hull. The at least one cooler is located in an outer hull of the two outer hulls.

In yet another embodiment, a method of cooling one or more propulsion system components of a boat includes urging a coolant flow through at least one chine cooler located inside a hull of the boat and abutting an external hull wall, and exchanging thermal energy between the coolant flow in the at least one chine cooler and a fluid flow outside of the hull via the external hull wall positioned between the flow of coolant and the fluid flow. The coolant flow is directed from the at least one chine cooler along one or more coolant passages defining at least one coolant loop. The one or more propulsion system components are located along the at least one coolant loop and are cooled via thermal energy exchange between the coolant flow and the one or more propulsion system components. The coolant flow is urged from the coolant loop to the at least on chine cooler.

The above features and advantages, and other features and advantages of the disclosure are readily apparent from the following detailed description when taken in connection with the accompanying drawings.

BRIEF DESCRIPTION OF THE DRAWINGS

Other features, advantages and details appear, by way of example only, in the following detailed description, the detailed description referring to the drawings in which.

DETAILED DESCRIPTION

Figure 1:
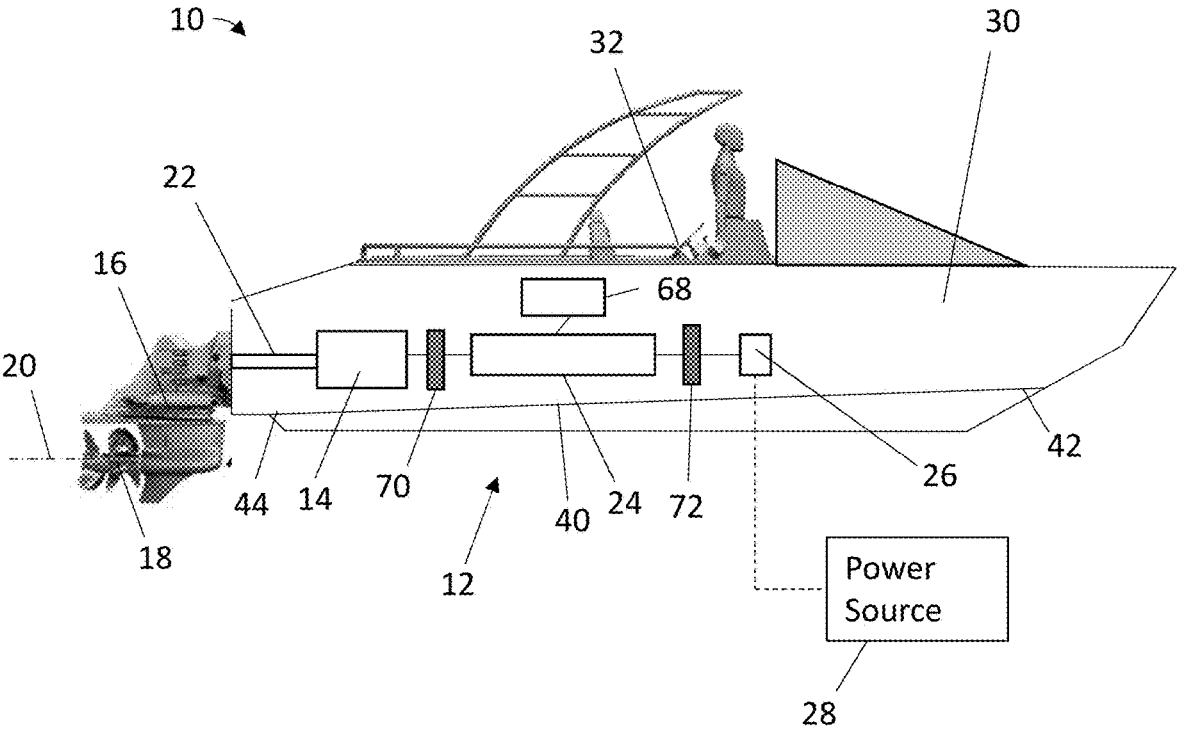
FIG. 1 is a schematic illustration of an embodiment of a watercraft.

The following description is merely exemplary in nature and is not intended to limit the present disclosure, its application or uses. It should be understood that throughout the drawings, corresponding reference numerals indicate like or corresponding parts and features.

In accordance with an exemplary embodiment illustrated in FIG. 1 is an embodiment of a watercraft, or boat 10. The boat 10 has a propulsion system 12, which, in the embodiment of FIG. 1, includes an electric motor 14 connected to a stern drive 16 that propels the boat 10 via rotation of a prop 18 about a prop axis 20. In some embodiments, the electric motor 14 is connected to the stern drive 16 via a drive shaft 22, while in other embodiments the drive shaft is omitted and the electric motor 14 and the stern drive 16 are directly connected. While a stern drive 16 configuration is illustrated and described herein, one skilled in the art will appreciate that the present disclosure may be readily applied to boats 10 having other propulsion system configurations, such as inboard or outboard motor configurations. Operation of the electric motor 14 drives rotation of the drive shaft 22, which in turn urges rotation of the prop 18 either directly or via intermediate connections or gear reduction arrangements (not shown). The electric motor 14 is powered by one or more batteries 24 connected to the electric motor 14. The batteries 24 are periodically recharged via, for example, an outlet 26 connected to a power source 28 when the boat 10 is docked or on shore. The propulsion system 12 further includes an accessory power module (APM) 68 that converts 350V DC to 12V DC power to charge an onboard 12V electrical system, a single power inverter module (SPIM) 70 that converts the 350V DC power to 3 phase AC power to power the electric motor 14, and onboard charging module (OBCM) 72 that converts AC power from the grid to DC power to charge the one or more batteries 24. The propulsion system 12 is arranged in a hull 30 and is operably connected to controls 32 operable by a user of the boat 10. In some embodiments, the hull 30 is formed from aluminum, but in other embodiments other materials, such as fiberglass, are used in hull 30 construction.

Figure 2:
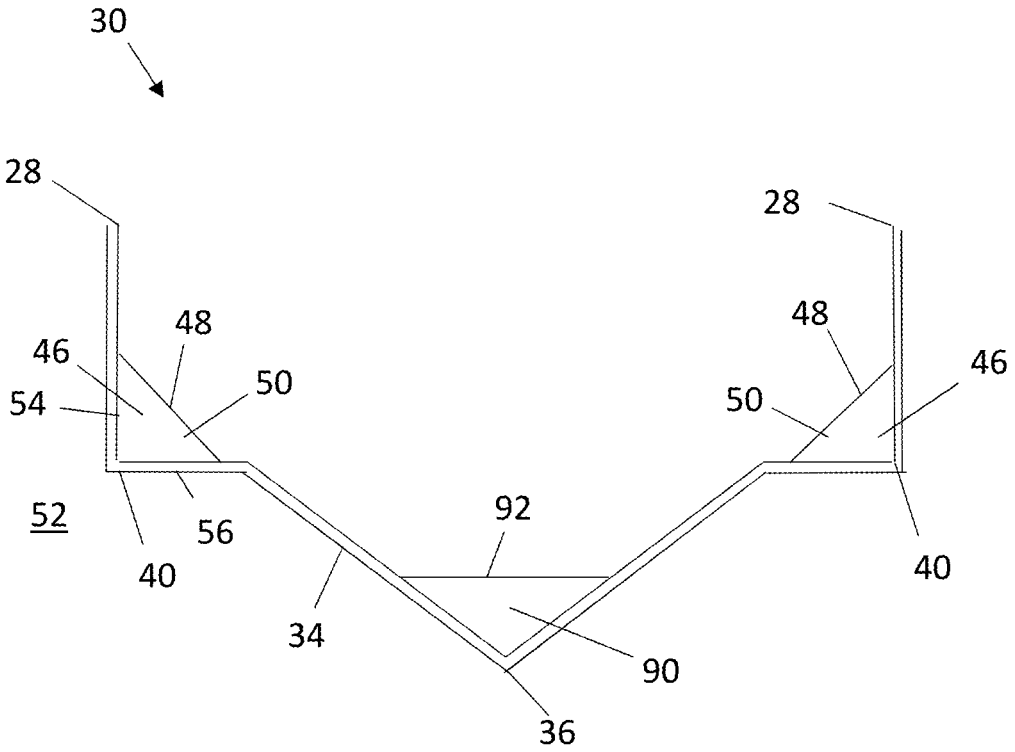
FIG. 2 is a cross-sectional view looking forward to aft of an embodiment of a hull.

Referring now to FIG. 2 a schematic cross-sectional view looking aft of an embodiment of a hull 30 is shown. The hull 30 has a V-shaped bottom, with a hull outer surface 34 extending from a keel 36 toward a rail 38. The hull outer surface 34 has one or more chines 40, or sharp changes in angle between the keel 36 and the rail 38. In the embodiment of FIG. 2, the hull outer surface 34 includes a chine 40 formed by a ninety-degree change in angle of the hull outer surface 34. It is to be appreciated that the hull outer surface 34 shape, and the chines 40 illustrated are merely exemplary and that one skilled in the art will readily appreciate that the present disclosure may be applied to other hull outer surface 34 shapes and chine 40 configurations. As shown in FIG. 1, the chines 40 extend lengthwise along the hull 30 from a chine first end 42 to a chine second end 44.

Referring again to FIG. 2, the chine 40 defines a chine recess 46 inside the hull 30. A chine closure 48 is secured and sealed to the hull 30 at the chine 40, for example, between the chine 40 and the keel 36 and between the chine 40 and the rail 38. The chine closure 48 encloses the chine recess 46 and defines, together with the hull 30 a sealed chine cooler 50 within the chine recess 46. In some embodiments, the chine closure 48 is secured to the hull 30 by, for example, welding. The chine closure 48 may be formed from the same material as the hull 30, for example, aluminum, or may be formed from a material different from that of the hull 30, for example, a plastic or a fiber-reinforced composite material. The chine cooler 50 is closed to the outside of the hull 30. In other words, no passages or openings in the chine cooler 50 extend through the hull 30 to the outside thereof. In addition to, or as an alternative to, chine coolers 50, the boat 10 may include one or more keel coolers 90, defined by securing and sealing a keel closure 92 at the keel 36, as shown in FIG. 2.

Coolant is flowed through the chine cooler 50. In some embodiments, the coolant is water or other fluid. Thermal energy is conducted away from the coolant in the chine cooler 50 through the hull outer surface 34 abutting the chine cooler 50 and to the body of water 52 in which the boat 10 is operating. Due to the shape of the chine recess 46, the thermal energy is conducted from the chine cooler 50 through an upper portion 54 of the chine cooler 50 between the rail 38 and the chine 40 and a lower portion 56 of the chine cooler 50 between the chine 40 and the keel 36. The efficiency of the thermal energy transfer is improved when the hull 30 is formed from a highly thermally-conductive material, such as aluminum.

Figure 3:
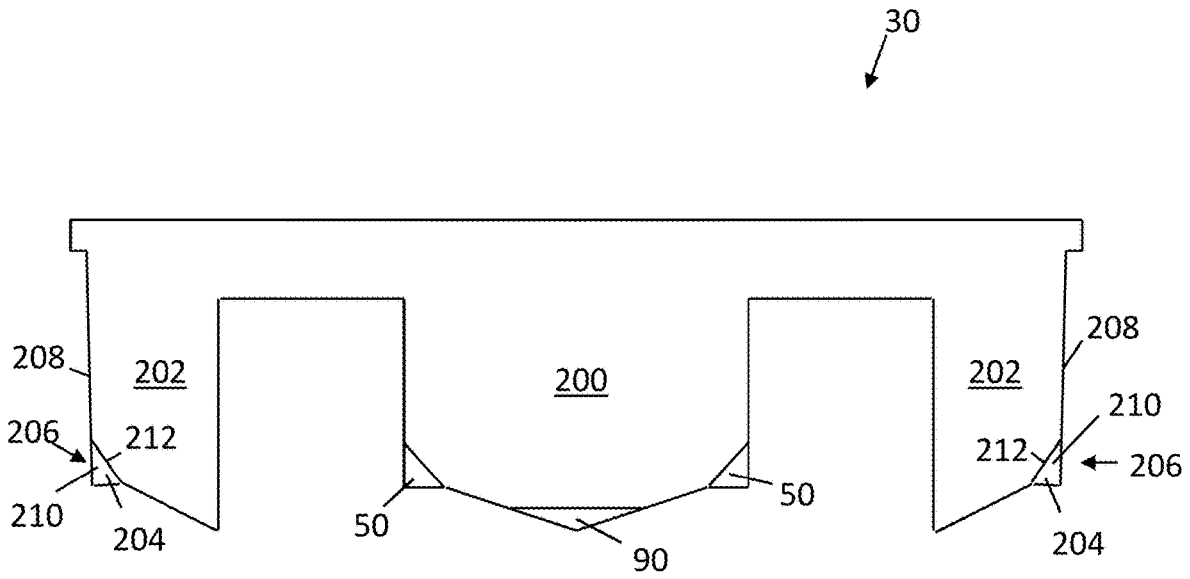
FIG. 3 is a cross-sectional view looking forward to aft of another embodiment of a hull.

In another embodiment, illustrated in FIG. 3, the hull 30 is a multi-hull configuration having, for example, a center hull 200 and two outer hulls 202 located laterally outboard of the center hull 200. In the embodiment of FIG. 3, the center hull 200 may include one or more chine coolers 50 and/or one or more keel coolers 90 as described above with reference to FIG. 2. Additionally or alternatively, one or more of the outer hulls 202 may include an outer hull cooler 204. In some embodiments, the outer hull 202 includes an outward-facing outer hull strake 206. The outer hull strake 206 is defined as a protrusion in an outer hull surface 208 and defines a strake recess 210 inside the outer hull 202. A strake closure 212 encloses the strake recess 210 and defines, together with the outer hull 202 the sealed outer hull cooler 204 within the strake recess 210. In some embodiments, the strake closure 212 is secured to the outer hull 202 by, for example, welding. One skilled in the art will readily appreciate that the outer hull cooler 204 may be utilized in addition to or as an alternative to the chine coolers 50 and keel coolers 90 described herein.

Figure 4:
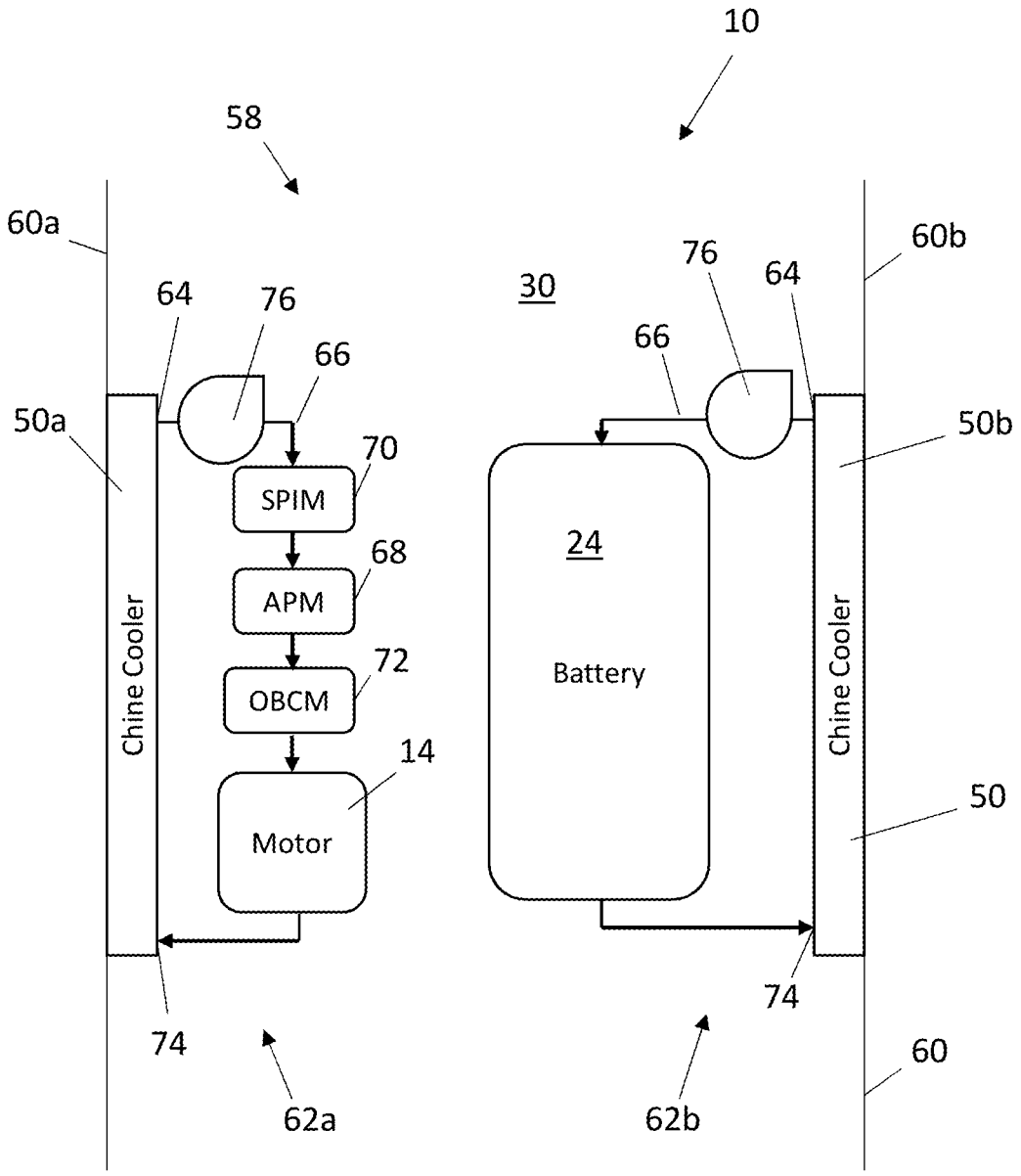
FIG. 4 is a schematic illustration of an embodiment of a cooling system for a boat, utilizing chine coolers.

Referring now to FIG. 4, the chine coolers 50 are part of a cooling system 58. FIG. 4 is a plan view of the hull 30 schematically illustrating an arrangement of boat 10 components therein. The cooling system 58 includes a chine cooler 50 at each lateral side 60 of the hull 30. A first chine cooler 50*a* is located at a first lateral side 60*a* of the hull 30 and is connected to a first coolant loop 62*a*. Coolant flows from the first chine cooler 50*a* via outlet port 64 and through coolant passage 66. The coolant flows through components arrayed along the coolant passage 66, such as accessory power module (APM) 68, single power inverter module (SPIM) 70, onboard charging module (OBCM) 72, and the electric motor 14. The coolant cools the components via thermal energy exchange therewith. The coolant is then returned to the first chine cooler 50*a* though inlet port 74. In some embodiments, the coolant is urged along the coolant passage 66 by a coolant pump 76. In the embodiment of FIG. 4, the coolant pump 76 is located between the outlet port 64 and the components, but in other embodiments the coolant pump 76 may be positioned in other locations along the coolant passage 56.

A second chine cooler 50*b* is located at a second lateral side 60*b* of the hull 30 opposite the first lateral side 60*a*, and is connected to a second coolant loop 62*b*. Coolant flows from the second chine cooler 50*b* via outlet port 64 and through coolant passage 66. The coolant flows through components arrayed along the coolant passage 56, such as the one or more batteries 24. The coolant cools the one or more batteries 24 via thermal energy exchange therewith. The coolant is then returned to the second chine cooler 50*b* though inlet port 74. In some embodiments, the coolant is urged along the coolant passage 66 by a coolant pump 76. In the embodiment of FIG. 4, the coolant pump 76 is located between the outlet port 64 and the one or more batteries 24, but in other embodiments the coolant pump 76 may be positioned in other locations along the coolant passage 56. In some embodiments, the first coolant loop 62*a* and the second coolant loop 62*b* operate at different temperatures.

Figure 5:
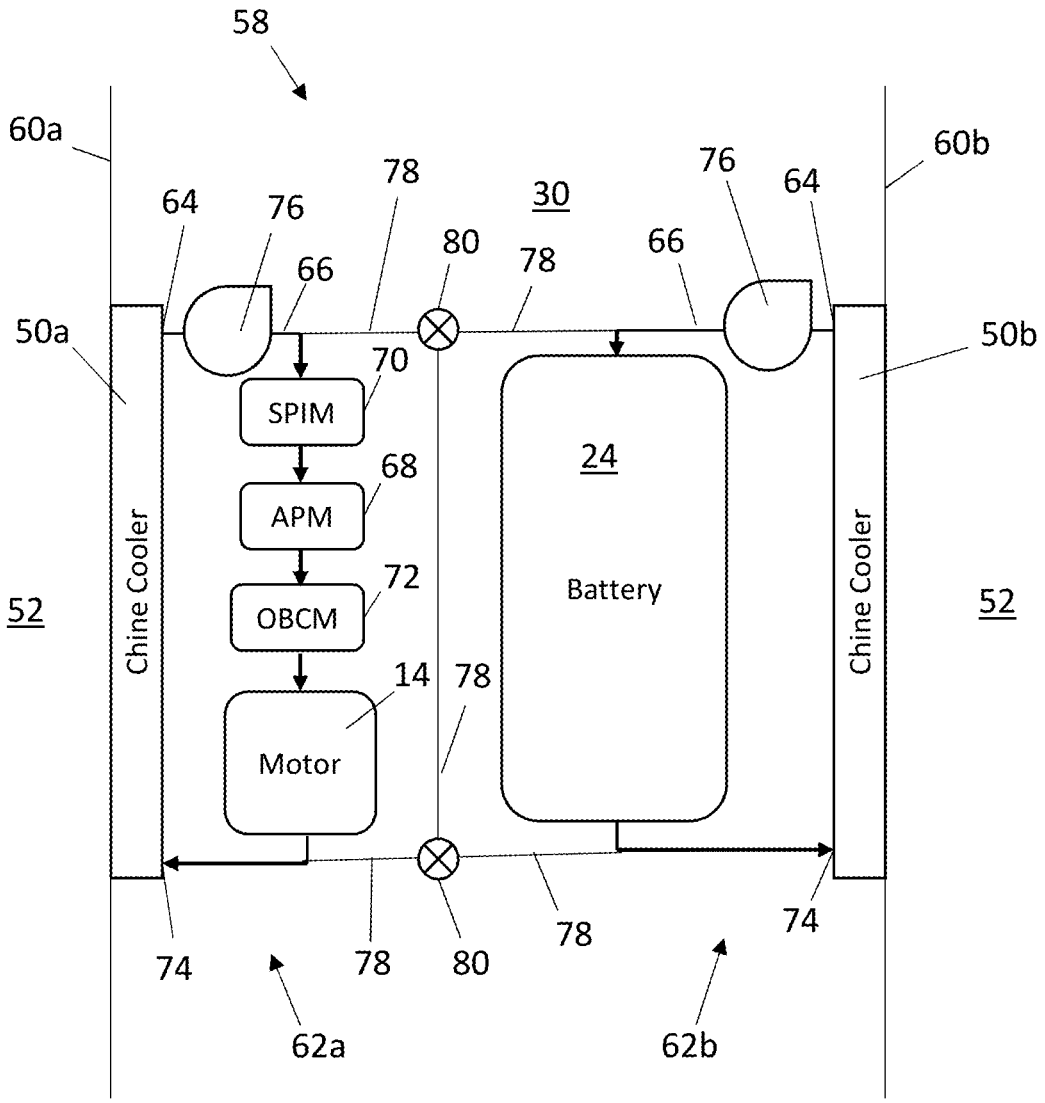
FIG. 5 is another schematic illustration of an embodiment of a cooling system for a boat utilizing chine coolers.
Figure 6:
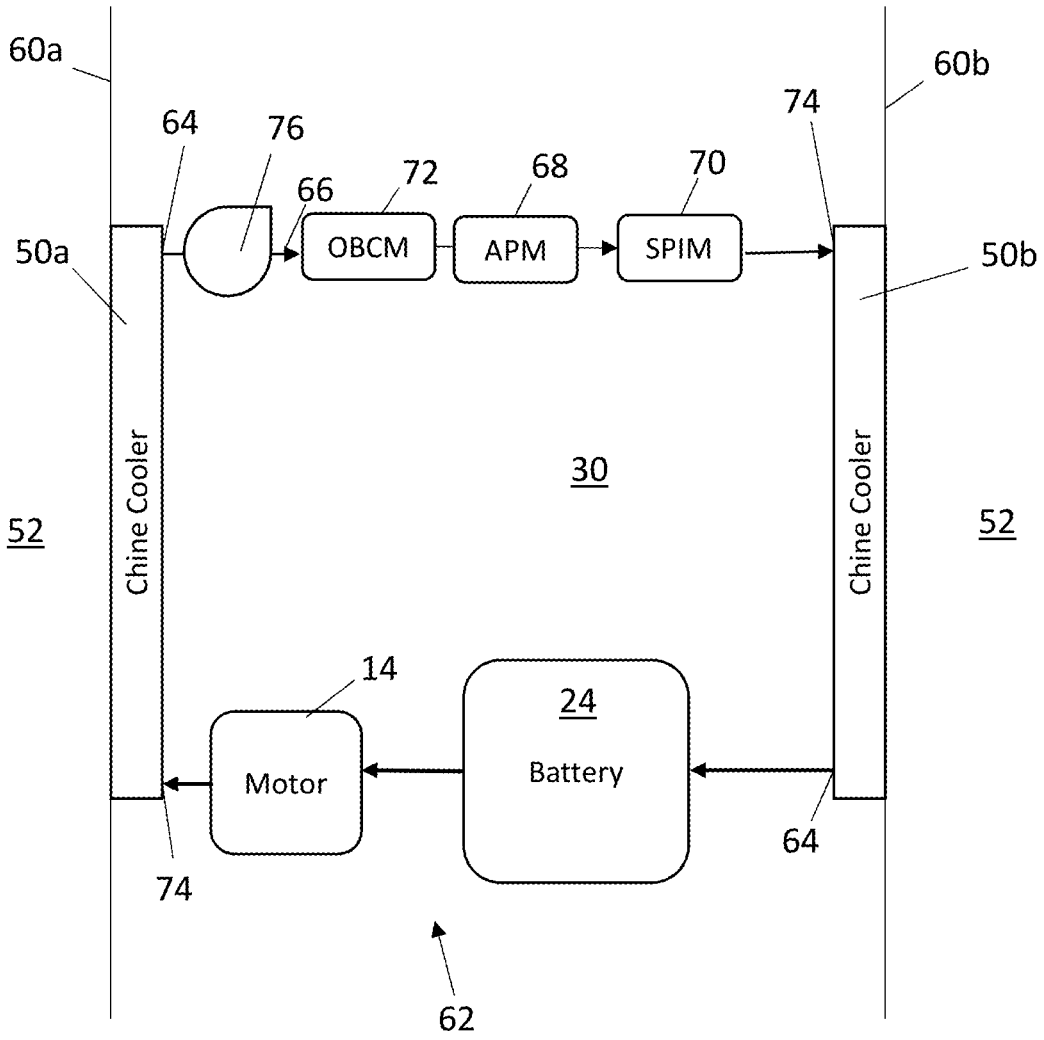
FIG. 6 is yet another schematic illustration of an embodiment of a cooling system for a boat using chine coolers.

While in the embodiment of FIG. 4, the first coolant loop 62*a* and the second cooling loop 62*b* are isolated such that the coolant in the first coolant loop 62*a* does not mix with the coolant in the second coolant loop 62*b*, in other embodiments such as shown in FIG. 5, the coolant from the first coolant loop 62*a* may be directed through the second coolant loop 62*b* and vice versa. In such embodiments, the cooling system 58 includes one or more connecting coolant passages 78 which connect the first coolant loop 62*a* to the second coolant loop 62*b*. Further, one or more valves 80 are located along the connecting coolant passages 78 to selectably direct coolant along the passages of the cooling system 58. For example, under certain operating conditions, the one or more batteries 24 may need additional cooling beyond what is provided by the coolant in the second coolant loop 62*b*. In such cases, the valves 80 may be selectably opened to direct additional coolant from the first coolant loop 62*a* through connecting coolant passages 78 and through the second coolant loop 62*b* to provide the additional cooling to the one or more batteries 24. When the one or more batteries 24 are sufficiently cooled and it is determined that the additional cooling is no longer required, the valves 80 may be closed. Further, as shown in the embodiment of FIG. 6, the chine coolers 50*a,b* and components may be arranged in a single coolant loop 62, with the chine coolers 50*a,b* arranged in series. A single pump 76 may drive the coolant through the single coolant loop 62.

The cooling system 58 disclosed herein provides a relatively low maintenance solution to cooling of the onboard electrical components, as the system is closed to the hull exterior and thus does not require annual winterizing. Further, the disclosed cooling system 58 is still operational when the boat 10 is out of the water, as the flow of coolant may readily exchange thermal energy with the outside air at the hull outer surface 34 via the chine cooler 50. Further still, the cooling system 58 may be readily fitted to an existing hull 30 without drilling holes in the hull 30 and does not protrude from the hull outer surface 34 and thus does not change the hydrodynamic performance of the hull 30. This solution also eliminates the need for a fresh water cooling pump, therefore making the entire system more efficient, and also eliminates the need for a large water-coolant heat exchanger, which can save up to 100 pounds from a boat, therefore increasing performance and efficiency While the above disclosure has been described with reference to exemplary embodiments, it will be understood by those skilled in the art that various changes may be made and equivalents may be substituted for elements thereof without departing from its scope. In addition, many modifications may be made to adapt a particular situation or material to the teachings of the disclosure without departing from the essential scope thereof. Therefore, it is intended that the present disclosure not be limited to the particular embodiments disclosed, but will include all embodiments falling within the scope thereof.

What is claimed is:

1. A cooling system for a boat, comprising: at least one cooler disposed inside a hull of the boat and closed to the exterior of the hull, the cooler configured for the exchange of thermal energy between a flow of coolant in the at least one cooler and a fluid flow outside of the hull via a hull wall disposed between the flow of coolant and the fluid flow; and one or more coolant passages extending from the at least one cooler defining at least one coolant loop, the one or more coolant passages configured to deliver the flow of coolant from the at least one cooler to one or more components disposed along the at least one coolant loop to cool the one or more components, and return the flow of coolant to the at least one cooler; wherein the at least one cooler is disposed at a chine of the hull; and wherein a chine closure is secured to an interior of the hull to enclose a chine recess defined by the chine, the enclosed chine recess defining a cooler of the at least one cooler.

2. The cooling system of claim 1, wherein the chine closure is secured to the interior of the hull via welding.

3. The cooling system of claim 1, wherein the hull is formed from aluminum.

4. The cooling system of claim 1, wherein the one or more components are one or more electrical components of a boat propulsion system.

5. The cooling system of claim 1, further comprising a pump to urge the flow of coolant along the at least one coolant loop.

6. The cooling system of claim 1, wherein the at least one cooler is two coolers disposed at opposing lateral sides of the hull.

7. The cooling system of claim 6, wherein the at least one cooling loop is two coolant loops and wherein a first coolant loop of the two coolant loops includes a first cooler of the two coolers, and a second coolant loop of the two coolant loops includes a second cooler of the two coolers.

8. The cooling system of claim 7, wherein the first coolant loop and the second coolant loop are configured and arranged to cool different components of the one or more components.

9. The cooling system of claim 1, wherein the fluid flow is one of water or air.

10. A boat, comprising: a hull; a propulsion system disposed in the hull and configured to propel the hull; a cooling system disposed in the hull and configured to cool one or more components of the propulsion system, the cooling system including: at least one cooler disposed inside the hull and closed to the exterior of the hull, the cooler configured for the exchange of thermal energy between a flow of coolant in the at least one cooler and a fluid flow outside of the hull via a hull wall disposed between the flow of coolant and the fluid flow; and one or more coolant passages extending from the at least one cooler defining at least one coolant loop, the one or more coolant passages configured to deliver the flow of coolant from the at least one cooler to the one or more components disposed along the at least one coolant loop to cool the one or more components, and return the flow of coolant to the at least one cooler, wherein the at least one cooler is disposed at a chine of the hull; and wherein a chine closure is secured to an interior of the hull to enclose a chine recess defined by the chine, the enclosed chine recess defining a cooler of the at least one cooler.

11. The boat of claim 10, wherein the at least one cooler is two coolers disposed at opposing lateral sides of the hull.

12. The boat of claim 11, wherein the at least one cooling loop is two coolant loops and wherein a first coolant loop of the two coolant loops includes a first cooler of the two coolers, and a second coolant loop of the two coolant loops includes a second cooler of the two coolers.

13. The boat of claim 12, wherein the first coolant loop and the second coolant loop are configured and arranged to cool different components of the one or more components.

14. The boat of claim 10, wherein the propulsion system is an electrical propulsion system including:

an electric motor;

a prop operably connected to the electric motor and driven thereby; and one or more batteries operably connected to the electric motor to provide electrical power to the electric motor;

wherein the one or more components include at least one of the electric motor or the one or more batteries.

15. The boat of claim 10, further comprising:

a center hull; and two outer hulls disposed laterally outboard of the center hull;

wherein the at least one cooler is disposed in an outer hull of the two outer hulls.

16. A method of cooling one or more propulsion system components of a boat, comprising:

urging a coolant flow through at least one chine cooler disposed inside a hull of the boat and abutting an external hull wall;

exchanging thermal energy between the coolant flow in the at least one chine cooler and a fluid flow outside of the hull via the external hull wall disposed between the flow of coolant and the fluid flow;

directing the coolant flow from the at least one chine cooler along one or more coolant passages defining at least one coolant loop;

cooling the one or more propulsion system components disposed along the at least one coolant loop via thermal energy exchange between the coolant flow and the one or more propulsion system components; and urging the coolant flow from the coolant loop to the at least one chine cooler;

wherein the at least one chine cooler is disposed at a chine of the hull; and wherein a chine closure is secured to an interior of the hull to enclose a chine recess defined by the chine, the enclosed chine recess defining a chine cooler of the at least one chine cooler.

* * * * *